United States Patent [19]

Wivinis

[11] Patent Number: 4,472,867

[45] Date of Patent: Sep. 25, 1984

[54] SHEET METAL WRAPPING TOOL

[76] Inventor: Gerald P. Wivinis, P.O. Box 398, North Chicago, Ill. 60064

[21] Appl. No.: 597,204

[22] Filed: Apr. 6, 1984

Related U.S. Application Data

[63] Continuation of Ser. No. 518,763, Aug. 1, 1983, abandoned, which is a continuation of Ser. No. 286,576, Jul. 24, 1981, abandoned.

[51] Int. Cl.[3] ..... B23P 11/00

[52] U.S. Cl. ..... 29/243.5; 72/211

[58] Field of Search ..... 29/243.5, 796; 72/210, 72/211, 199, 207

[56] References Cited

U.S. PATENT DOCUMENTS

| | | | |
|---|---|---|---|
| 17,874 | 7/1857 | Fay | 29/243.5 |
| 42,966 | 5/1864 | Roys | 29/243.5 |
| 331,586 | 12/1885 | Wagenhurst | 29/243.5 |
| 465,906 | 12/1891 | Weitmyer | 29/243.5 |
| 1,317,627 | 9/1919 | Kennedy | 72/211 |
| 1,976,148 | 10/1934 | Sonntag | 29/243.5 |
| 2,660,909 | 12/1953 | Morse et al. | 72/211 |
| 2,982,331 | 5/1961 | Bonner | 72/210 |
| 3,680,346 | 8/1972 | Wilcox | 72/211 |
| 3,771,482 | 11/1973 | Thompson | 29/243.5 |
| 3,875,642 | 4/1975 | Knudson | 29/243.5 |

*Primary Examiner*—Frederick R. Schmidt
*Assistant Examiner*—Steven P. Schad
*Attorney, Agent, or Firm*—Robert E. Knechtel

[57] ABSTRACT

A tool for bending a lip on sheet metal around a frame, particularly useful in bending a sheet metal door panel around an automobile door frame. The operator manually grasps the tool handle in one hand while operating a ratchet with his other hand to drive the tool and bend the sheet metal. The ratchet operates a drive roller which causes the tool to move forward while also bending the lip of the sheet metal around the frame.

3 Claims, 6 Drawing Figures

FIG. 1
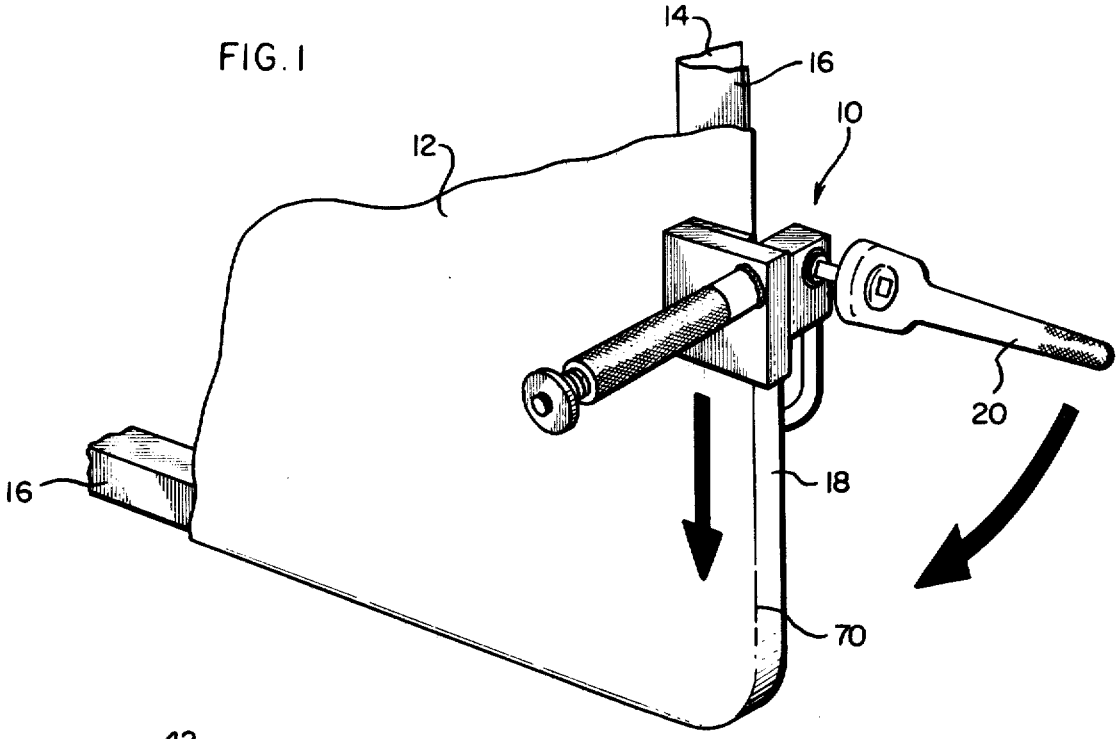
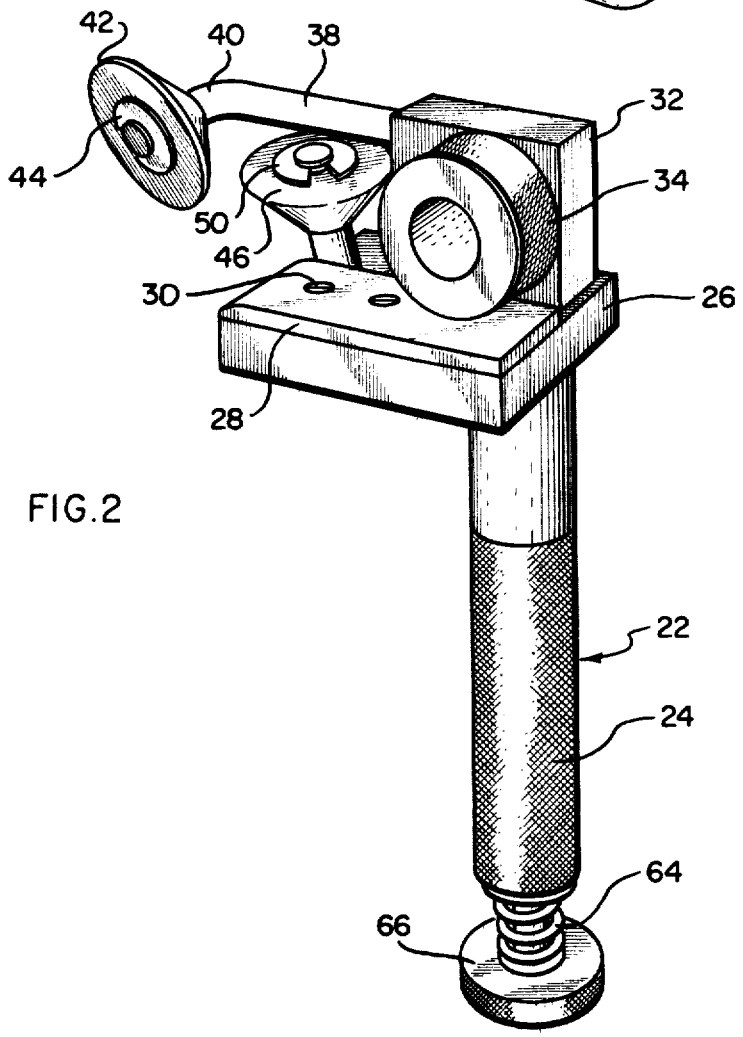
FIG. 2

FIG. 3
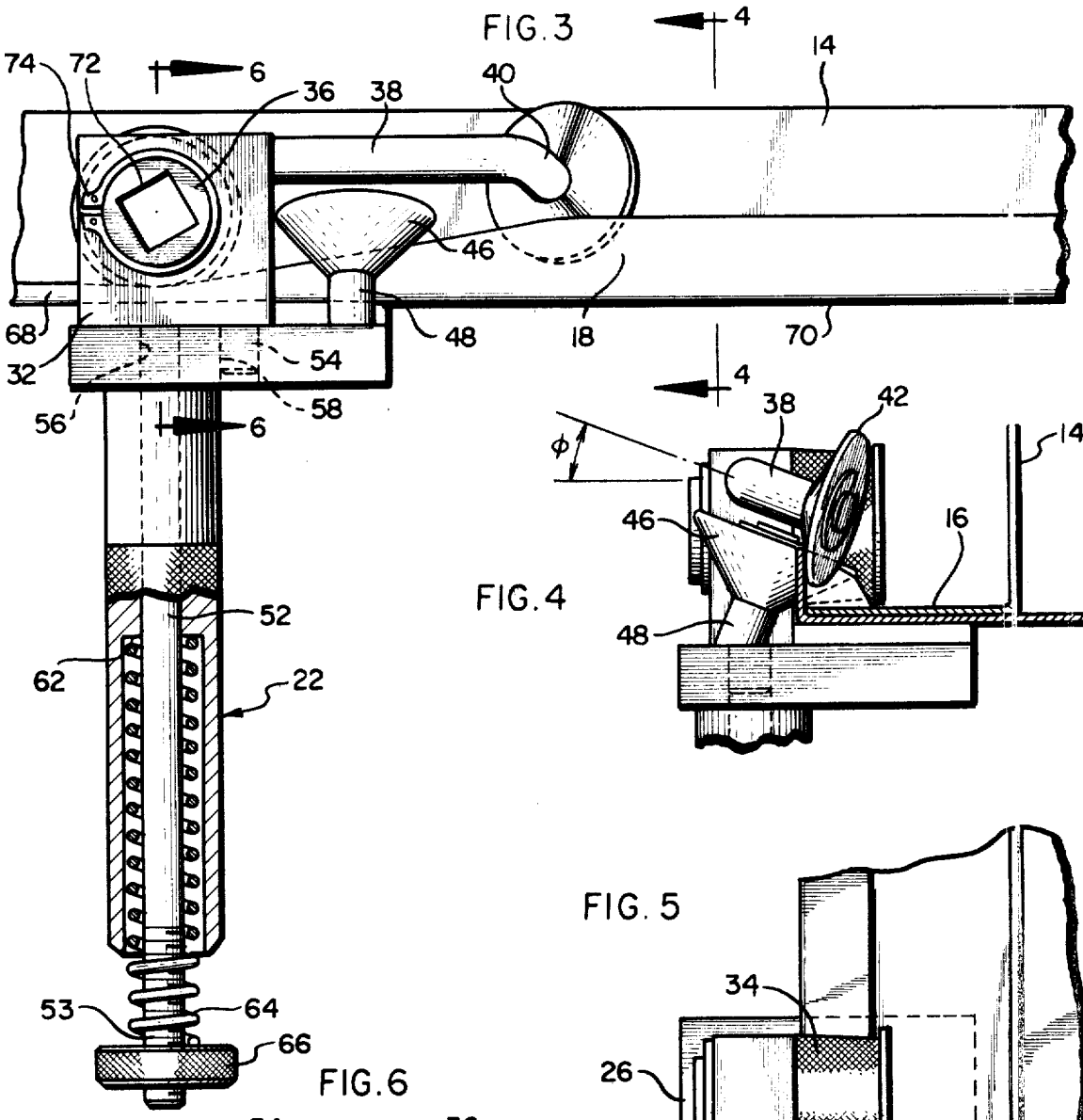
FIG. 4
FIG. 5
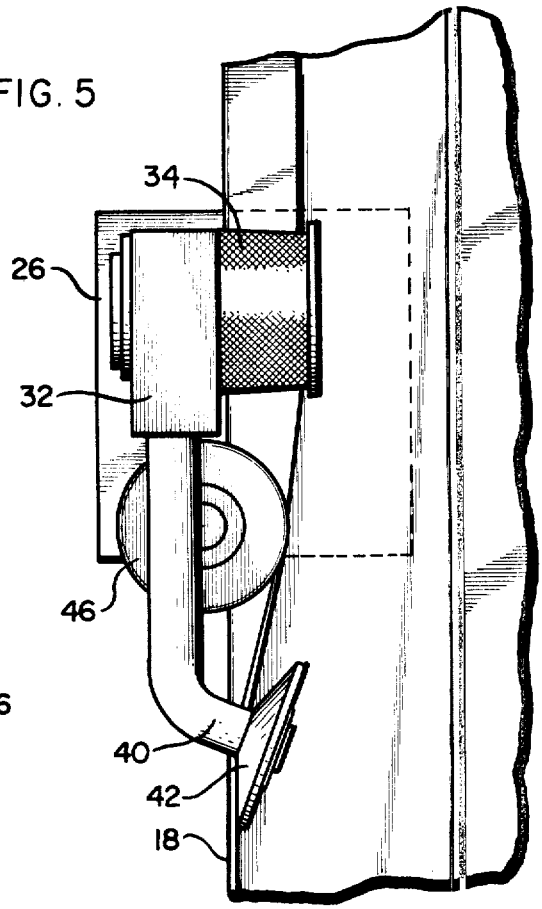
FIG. 6
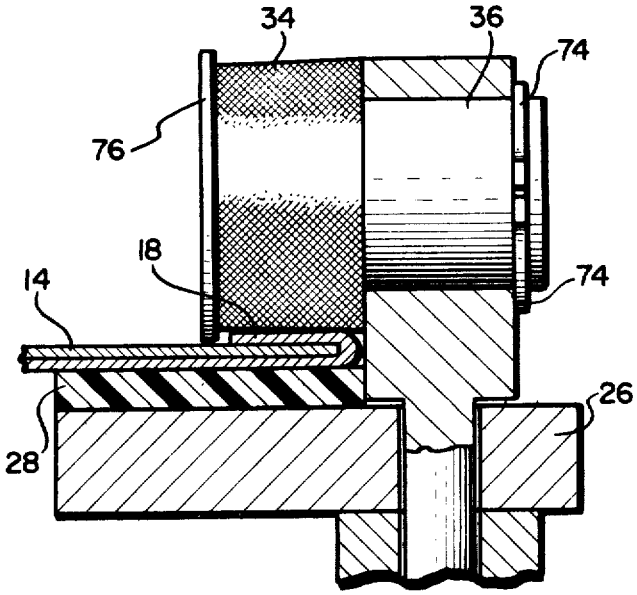

SHEET METAL WRAPPING TOOL

This application is a continuation of application Ser. No. 518,763, filed 8/1/83, which is, in turn, a continuation of application Ser. No. 296,576, filed 7/24/81, both now abandoned.

BACKGROUND AND SUMMARY OF THE INVENTION

This invention is directed to a tool used to wrap a lip on sheet metal around a frame. It is particularly useful in joining an automobile door panel around the door frame.

The technique most commonly used to join a door panel with a door frame is to prepare a lip on the door panel by using a hammer and dolly or hammering block. The lip is formed by striking the edge of the panel with the hammer and using the dolly as a backstop to form the lip at the proper angle. The door frame is then placed against the door panel and the lip is bent around the frame by using the same hammer and dolly. The problem with using this method is that the hammer can leave marks on the door frame or panel as a result of the hammering operation. This is to be avoided if the new door panel is to have as smooth a surface as possible with a minimum amount of finishing. Furthermore, the hammer and dolly method is labor intensive and takes a great deal of time and skill to carefully prepare and complete the job.

The present invention solves the problems of the prior art in that the inventive tool performs the bending and joining operation without the need to continuously hammer and bend the panel lip around the door frame. With this invention, the lip must only be initially bent and then the tool completes the balance of the bending operation. The sheet metal wrapping tool also eliminates the possibility of marring the panel surface with nicks and gouges as often result when using a hammer and dolly. The tool is also easy to use and requires little physical strength in that a ratchet drive is connected to the tool and provides the leverage necessary to supply the driving force with very little effort on the part of the user. Furthermore, there are not any gaps on the lip where the lip fails to make adequate, secure contact with the frame such as can result when using a hammer and dolly.

The inventive tool bends the upstanding lip on a piece of sheet metal around a frame in which the sheet metal and frame each have at least one surface in contact. The operator grasps the tool in one hand and the drive ratchet in his other hand. The tool has a base plate with a smooth surface which contacts one side of the sheet metal and a drive roller connected to the ratchet drive is positioned on the other side of the sheet metal. A guide and bending roller positioned forward of the drive roller initally bends the lip inward a sufficient distance so that the drive roller can easily complete the bending of the lip around the frame. In addition to bending the lip around the frame, the drive roller also moves the tool forward so that the bending process can continue. The tool preferably has another guide roller extending forward from the drive roller to keep the tool moving along the frame and panel in the proper direction and alignment. After the tool has bent the upstanding lip on the panel around the frame, the two units are secured to each other.

Many other objects and purposes of the invention will be clearer from the following detailed description of the invention.

BRIEF DESCRIPTION OF THE DRAWINGS

FIG. 1 is a perspective view of the tool in operation joining a door panel to a frame with sections of the panel and frame removed;

FIG. 2 is a perspective view of the inventive tool;

FIG. 3 is a side view of the tool, partially sectionized;

FIG. 4 is a sectional view taken along lines 4—4 of FIG. 3;

FIG. 5 is a top plan view of the tool illustrating the same in use in joining a door panel to a frame; and FIG. 6 is a sectional view taken along lines 6—6 of FIG. 3.

DESCRITPION OF THE PREFERRED EMBODIMENT

Turning first to FIG. 1, there is illustrated a sheet metal wrapping tool 10 set in its operative environment of bending a sheet metal door panel 12 (panel) around a door frame 14 (frame) having a frame surface 16. The panel 12 has an upstanding lip 18 which is the portion of the panel 12 to be bent around the frame surface 16. The lip is formed by bending the edge of the panel 12 upward in a manner usually done by those who work and are skilled in the art. A ratchet driver 20 is operated by the user of the tool to impart the force required to operate the tool 10, as will be more fully described later.

FIG. 2 illustrates the overall appearance of the tool 10. A handle 22 has a textured grasping area 24 which assists the tool user in obtaining a non-slipping grasp on the tool 22. At the top of the handle 22 a base plate 26 is securely attached thereto normally by means of welding or other standard joining methods. On one portion of the base plate 26 is mounted a Teflon plate or surface 28. The surface must be smooth enough to allow the panel 12 to slide along the surface 28 and strong enough to resist abrasion. The plate 28 can be affixed to the base plate 26 by means of adhesives or screws 30 as illustrated in FIG. 2.

Also mounted on the base plate 26 is a rectangular head 32. The method of affixing the head 32 to the handle 22 will be more fully described below. A drive roller 34 is affixed to a shaft 36 (FIG. 3) and is positioned over and spaced apart from the surface 28. Extending from the head 32 in a forward direction, which is the direction of travel of the tool in operation, is a guide arm 38 having a bent forwardmost end 40. Attached to the bend end 40 is a first or front guide roller 42 which is rotatably secured in place by means of a retainer washer 44.

A second guide and bending roller 46 is mounted to shaft 48 which is secured to the forwardmost portion of the base plate 26. Retainer washer 50 rotatably secures the second guide roller to the end of shaft 48 in a manner similar to the method used to secure roller 42.

FIG. 3 more clearly illustrates the method of affixing the head 32 to the base plate 26 so that it can be adjustably spaced relative to the base plate 26 to permit the tool to be initially positioned for operation and subsequently clamped on the panel and door frame, as more particularly described below. There is an elongated adjusting shaft 52 which has its upper end disposed within a cylindrical bore (not illustrated) in the head 32. The adjusting shaft 52 has a threaded bottom 53. A stub shaft 54 is similarly mounted into the head 32 slightly forward of the adjusting shaft 52. The stub shaft keeps the head 32 from unwanted rotative movement while using the tool. The adjusting shaft 52 extends through a passageway 56 in the base plate 26. Stub shaft 54 seats within passageway 58 in the head 32. Both passageways 56, 58 are dimensioned to closely receive shafts 52, 54 but yet not seize them.

While not necessary, but in some cases, it is advantageous to provide within the handle 22 from approximately its center to its lowermost end, an enlarged bore or spring cavity 60. At the uppermost end of the spring cavity 60 is an internal spring stop 62 formed by the end wall of the spring cavity 60. Positioned within the spring cavity 60 is a helical spring 64. The spring 64 is captured between a threaded knob 66 on the threaded bottom 53 and the spring stop 62. Thus, it can be seen that as the threaded knob 66 is rotated to cause the threaded knob 66 to move up on the threaded bottom 53, the spring is placed under greater compression. This forces the handle 22 against the base plate 26 with increasing force. To counteract this force, the spring 64 pushes against the threaded knob 66 thus forcing the adjusting shaft 52 to pull the head 32 down towards the base plate 26. As the shaft 36 and its associated drive roller 34 are retained by the head 32, it can be seen that as the head moves, the drive roller 34 moves also. This adjustment is necessary to allow initial positioning of the tool on the panel 12 and then permits tightening of the drive roller 34 down onto the lip 18 as it is bent around the frame 14.

In order to use the tool 10 in its intended application of fastening a new door panel to the door frame, some preparation is necessary. First, the frame 14 must be straightened and any spot welds must be made even and smooth. The new panel 12 must have an upstanding lip 18 of a suggested lip height of ⅜ inch to ½ inch. An initial length of the upstanding lip 18 must be folded over with a hammer and dolly as illustrated at 68 in FIG. 3. The lip 18 should be approximately 1 inch from the flat portion 68 to the vertical upstanding portion 18. This rolling fold will aid the tool 10 in progressing forward with proper alignment. A running or break edge 70 must be ground at approximately a 30° angle to remove 0.005 inches of metal. A power sander performs this task well, however a file could also be used. This gives the edge a break point to follow as the upstanding lip 18 is bent.

The threaded knob 66 is screwed downward so that the head 32 can be raised from the base 26 approximately ¼ inch. A ratchet driver, preferably ⅜ inch, is fitted into a complementary square hole 72 at the end of the shaft 36. Shaft 36 is retained within the head 32 by means of a retainer washer 74.

The front guide roller 42 is inserted against the inside of the lip 18. The tool 10 is then swung into operating position. With the drive roller 34 positioned above the bent lip 68. The threaded knob 66 is tightened to squeeze the drive roller 34 down onto the initial bent lip 68 with sufficient force to allow the drive roller 34 to grab the surface of lip 68. The ratchet is slowly turned clockwise while the tool is guided by the operator and the guide rollers 42, 46.

In order to keep the tool 10 moving forward in proper alignment relative to the frame 14, the guide rollers 42, 46, and their associated shafts 38, 48, have been set at various angles. To further aid and maintain this alignment, the guide roller 42 has been beveled at approximately a 20° angle. As illustrated in FIG. 4, shaft 38 has been set at an angle of approximately 20° relative to the horizontal. Angle in $\phi$ in combination with the 20° beveling of the guide roller 42 results in the surface of roller 42 which is in contact with the inner surface of the lip 18, to be substantially flush with that inner surface. Additionally, as illustrated in FIG. 5, the bend 40 in guide arm 38 is approximately 20° also further aiding the guide roller 42 in having a substantial portion of its beveled edge in contact with the innermost portion of the upstanding lip 18.

The second guide roller 46 also functions as a bending roller. It is affixed to the end of shaft 48 which is set at approximately a 40° angle relative to the surface 28. The sides of guide roller 46 are beveled at approximately 40°. This second guide roller 46 aids the tool in moving forward in proper alignment along the frame 14 and also assists in bending by exerting a folding force against the lip 18 which causes the lip 18 to begin folding inwardly. The drive roller 34 can then complete the folding and bending operation as the partially bent lip 18 comes under roller 34.

In FIG. 6 it can be seen that the drive roller 34 has a textured surface to aid in grabbing the surface of the lip 18 as it is bent around the frame 14. This is necessary so that the drive roller 34 will continue moving the tool 10 forward as the ratchet 20 is rotated. It can be also be seen that the drive roller 34 is preferably tapered inward toward its outermost extremity furthest from the ratchet driver 20. It was found that by tapering the drive roller 34 in this manner, the tool tended to remain perpendicular to the frame 14 (which is desirable) instead of moving along at an angle other than 90° relative to the frame. A roller cap 76 comes in contact with the frame 14 and is of a slightly larger diameter than the roller 34. This roller cap 76 keeps the tool moving in a straight line and prevents wandering of the tool as the roller cap 76 will strike the bent over edge 18 should the tool begin moving out of alignment. The roller cap 76 thus aids in restraining the tool from walking up over the bent lip 18.

Many changes and modifications in the abovedescribed embodiment of the invention can, of course, be carried out without departing from the scope thereof. For example, while it is disclosed that a ratchet is used to operate the tool, obviously other power operated drive means could as well be used. Furthermore, while it is preferred to taper the drive roller as described, it need not be tapered. Accordingly, that scope is intended to be limited only by the scope of the appended claims.

I claim:

1. A tool for joining a sheet metal automobile door panel to a flat door frame, the sheet metal door panel having a back surface, a front surface and an upstanding lip which is perpendicular to the front surface, the tool being operable to roll over and crimp the upstanding lip on the sheet metal door panel about the edge of the flat door frame to sandwich the flat door frame between the lip and the back surface of the sheet metal door panel, said tool comprising:

handle means to be manually grasped by an operator to support the tool during use thereof;

a stationary base plate connected to the handle means;

a flat, slidable, abrasion resistant surface connected to the base plate which slidably contacts the sheet metal front surface during bending for preventing the contacted sheet metal front surface from being marred with nicks and gouges;

a driven roller means supported atop the flat surface with its axis parallel thereto coupled to the base plate;

the surface of the driven roller means being formed to fictionally-grab the back surface of the sheet metal and being driven to move the tool along the length of the sheet metal;

adjustment means comprising a shaft extending through said handle means and having one end thereof coupled to said driven roller means, the other end of said shaft being threaded and having a threaded knob thereon which is proportioned to abut against the end of said handle means, said knob being threadingly adjustable to position said driven roller means to receive and to clamp the lip, the sheet metal and the edge of the frame between the driven roller means and the flat, slidable, abrasion resistant surface on the base plate to crimp the lip about the edge of the frame with the frame sandwiched between the lip and the sheet metal as the driven roller means is being driven;

a bending roller supported forward of the driven roller means and having a conical surface engagable with the upstanding lip on the sheet metal, the bending roller means being operable to partially bend the upstanding lip about the edge of the frame ahead of the driven roller means, the upstanding lip being partially bent about the edge of the frame and then being crimped about the edge of the frame by the driven roller means as the tool is moved along the length of the sheet metal;

and a guide roller supported forward of the bending roller and resting against the upstanding lip to guide the tool in a direction substantially following the upstanding lip.

2. The tool of claim 1, wherein said driven roller means is adjustably positionable with respect to said flat, slidable, abrasion resistent surface on the stationary base plate to accommodate varying thickness of frames and sheet metal.

3. The tool of claim 2, wherein said driven roller means is adapted to receive and to be driven by a ratchet wrench.

* * * * *